US006684547B2

(12) United States Patent
Poff, Jr.

(10) Patent No.: US 6,684,547 B2
(45) Date of Patent: Feb. 3, 2004

(54) FIREARM RECOIL DAMPENING ASSEMBLY

(75) Inventor: Charles Richard Poff, Jr., Vero Beach, FL (US)

(73) Assignee: Cape Aerospace, Cape Coral, FL (US)

( * ) Notice: Subject to any disclaimer, the term of this patent is extended or adjusted under 35 U.S.C. 154(b) by 0 days.

(21) Appl. No.: 10/001,042

(22) Filed: Oct. 31, 2001

(65) Prior Publication Data

US 2003/0079394 A1 May 1, 2003

(51) Int. Cl.[7] ..... F41A 25/00

(52) U.S. Cl. ..... 42/1.06; 42/75.03; 89/158; 89/14.3

(58) Field of Search ..... 89/158, 194, 198, 89/199, 14.3; 42/1.06, 75.03, 74; 267/141.1, 293, 294

(56) References Cited

U.S. PATENT DOCUMENTS

| | | | | | |
|---|---|---|---|---|---|
| 1,563,675 | A | | 12/1925 | Tansley | |
| 1,568,005 | A | | 12/1925 | Sutter | |
| 1,788,279 | A | * | 1/1931 | Cutts | 267/33 |
| 1,822,079 | A | | 9/1931 | Bull et al. | |
| 1,930,098 | A | * | 10/1933 | Hossfeld | 267/153 |
| 2,108,026 | A | | 2/1938 | Sutter | |
| 2,154,586 | A | * | 4/1939 | Stern | 267/140.4 |
| 2,379,461 | A | | 7/1945 | Simpson | |
| 2,434,326 | A | | 1/1948 | Maciejowski | |
| 2,449,545 | A | | 9/1948 | Balleisen | |
| 2,509,530 | A | | 5/1950 | Rosengren et al. | |
| 2,509,540 | A | | 5/1950 | Sunderland | |
| 2,699,934 | A | * | 1/1955 | Boschi | 267/141.1 |
| 2,831,404 | A | | 4/1958 | Sampson et al. | |
| 2,866,389 | A | | 12/1958 | Simpson | |
| RE24,654 | E | * | 6/1959 | Sheets | 267/35 |
| 2,893,279 | A | * | 7/1959 | Haskell et al. | 123/183.1 |
| 2,900,877 | A | | 8/1959 | McClenahan | |
| 3,067,454 | A | * | 12/1962 | Catlin et al. | 42/1.12 |
| 3,089,391 | A | | 5/1963 | Raleigh | |
| 3,115,063 | A | | 12/1963 | Browning | |
| 3,336,838 | A | | 8/1967 | Wilson | |
| 3,366,011 | A | | 1/1968 | Sturtevant | |
| 3,566,744 | A | | 3/1971 | Stoner | |
| 3,831,923 | A | * | 8/1974 | Meldrum | 267/141 |
| 4,126,080 | A | | 11/1978 | Reynolds | |
| 4,244,273 | A | * | 1/1981 | Langendorfer et al. | 89/193 |
| 4,401,298 | A | * | 8/1983 | Eaton et al. | 267/140.13 |
| 4,498,369 | A | | 2/1985 | Kaiser | |
| 4,522,107 | A | | 6/1985 | Woodcock et al. | |
| 4,566,678 | A | * | 1/1986 | Anderson | 267/141.1 |
| 4,732,075 | A | * | 3/1988 | Hurd | 267/141.1 |
| 4,781,365 | A | * | 11/1988 | Harrison | 267/294 |
| 4,998,997 | A | * | 3/1991 | Carlston | 267/3 |
| 5,054,368 | A | | 10/1991 | Wentzel et al. | |
| 5,060,555 | A | | 10/1991 | Sater et al. | |
| 5,069,110 | A | | 12/1991 | Menck | |
| 5,410,833 | A | | 5/1995 | Paterson | |
| 5,465,645 | A | | 11/1995 | Cominolli | |
| 5,868,384 | A | * | 2/1999 | Anderson | 267/141.1 |
| 5,909,002 | A | | 6/1999 | Atchisson | |

FOREIGN PATENT DOCUMENTS

| | | | | |
|---|---|---|---|---|
| IT | 547220 | * | 8/1956 | 89/198 |

* cited by examiner

*Primary Examiner*—Michael J. Carone
*Assistant Examiner*—Gabriel S. Sukman
(74) *Attorney, Agent, or Firm*—Price, Heneveld, Cooper, DeWitt & Litton, LLP

(57) ABSTRACT

A recoil dampening assembly for a firearm that includes a bolt assembly and a stock that is linearly moveable with respect to the bolt assembly, includes a plurality of elastically deformable shock-absorbing members having a compression cavity defined therein, and a plurality of rigid spacers interspaced between the shock absorbing members. The plurality of shock absorbing members and rigid spacers are adapted to be placed between a bolt assembly of a firearm and a stock of a firearm. The plurality of shock-absorbing members and rigid spacers are adapted to dampen the recoil as transmitted from the bolt assembly to the stock when a charge that is in the firearm is ignited by allowing each shock absorbing member to at least partially compress within the compression zone.

41 Claims, 3 Drawing Sheets

FIREARM RECOIL DAMPENING ASSEMBLY

BACKGROUND OF THE INVENTION

The present invention relates to a recoil dampening system, and in particular to a recoil dampening assembly for a firearm that reduces the recoil as felt by the operator of the firearm.

Devices for reducing the recoil as exerted by a firearm and as felt by the operator typically include numerous springs located between the stock and the bolt assembly, chamber, etc., of the firearm. These previous designs required that a significant amount of space between the stock and bolt assembly be provided such that the springs utilized within the design may sufficiently compress. Conversely, if adequate spacing is not provided the springs will not sufficiently compress and the associated recoil dampener will not adequately dampen the recoil as transmitted to the operator. In addition, the small and compact design of many of today's firearms require compact recoil dampening devices, thereby eliminating the space required by "spring-based" systems. Further, most spring-based recoil dampening systems are constructed of material that corrodes over time and under adverse conditions in which the firearm becomes damp. Still further, the spring-based recoil dampening systems are typically heavy, thereby adding to the overall weight of the associated firearm that must be carried by the operator, sometimes over long distances and for extended periods of time.

A recoil dampening system is needed that sufficiently dampens the recoil as felt by the operator, yet is sufficiently small such that it may be incorporated within compact firearms. In addition, the recoil dampening device should be lightweight and capable of extended use.

SUMMARY OF THE INVENTION

One aspect of the present invention is to provide a recoil dampening assembly for a firearm that includes a bolt assembly and a stock that is linearly movable with respect to the bolt assembly. The recoil dampening assembly includes a plurality of elastically deformable cylindrically shaped shock-absorbing members having a compression cavity defined therein, and a plurality of rigid spacers interspaced between the shock-absorbing members. The plurality of shock-absorbing members and rigid spacers are adapted to be placed between a bolt assembly of a firearm and a stock of a firearm. The plurality of shock absorbing members and rigid spacers are further adapted to dampen the recoil as transmitted from the bolt assembly to the stock when a charge within the firearm is ignited by allowing each shock absorbing member to at least partially compress within the compression cavity.

Another aspect of the present invention is to provide a firearm including a recoil dampening assembly that includes a bolt assembly and a stock that is linearly movable with respect to the bolt assembly. The firearm also includes a plurality of elastically deformable cylindrically shaped shock absorbing members having a compression cavity defined therein, and a plurality of rigid spacers interspaced between the shock absorbing members. The plurality of shock absorbing members and rigid spacers are positioned between the bolt assembly and the stock of the firearm. The plurality of shock absorbing members and rigid spacers are adapted to dampen the recoil as transmitted from the bolt assembly to the stock when a charge within the firearm is ignited.

The present inventive recoil dampening assembly and associated firearm provides a durable, low-cost recoil dampening system having an uncomplicated design that can be easily and quickly assembled. The present inventive dampening system and associated firearm are further economical to manufacture, capable of a long operating life, and are particularly well adapted for the proposed use by significantly reducing the recoil as felt by the operator of the associated firearm.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
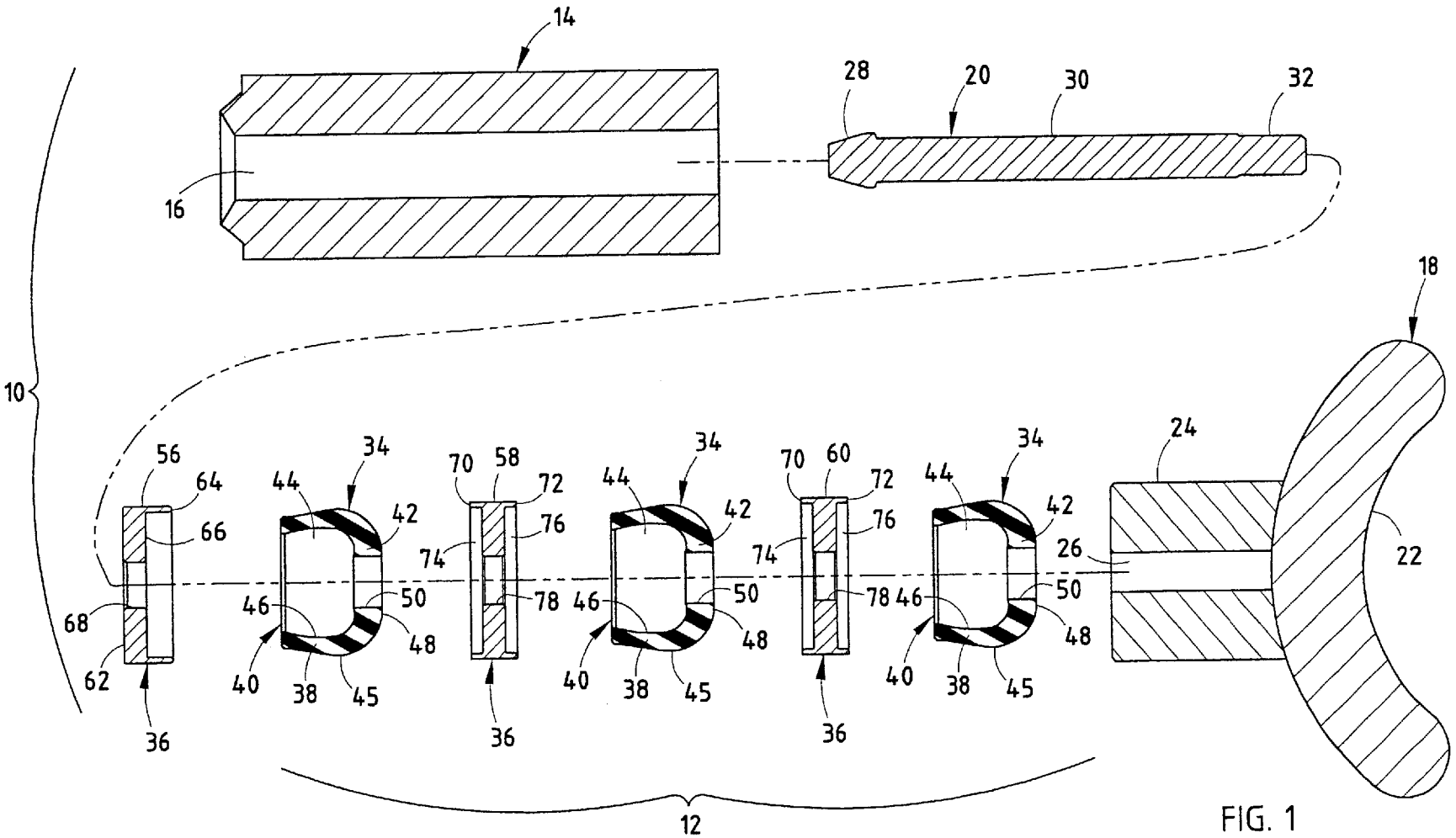
FIG. 1 is an exploded cross-sectional side elevation view of a firearm including a recoil dampening assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a firearm that includes a recoil dampening assembly 12 embodying the present invention. In the illustrated example, firearm 10 includes a bolt assembly 14 having a central bore 16 extending longitudinally therethrough. Firearm 10 further includes a stock 18 and a rod 20 extending between bolt assembly 14 and stock 18. Stock 18 includes a butt plate 22 and an impact member 24 fixedly attached to butt plate 22. Impact member 24 has a central bore 26 extending longitudinally therethrough. Rod 20 includes a first end 28 that is slidingly received within bore 16 of bolt assembly 14, a central portion 30, and second end 32 that is fixedly received within bore 26 of impact member 24. The recoil dampening assembly includes a plurality of cup-shaped shock absorbing members 34 and a plurality of disk-shaped spacers 36 interspaced between shock absorbing members 34.

Figure 2B:
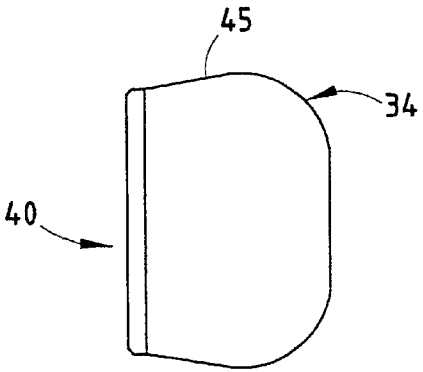
FIG. 2B is a side elevational view of the shock-absorbing member.
Figure 4:
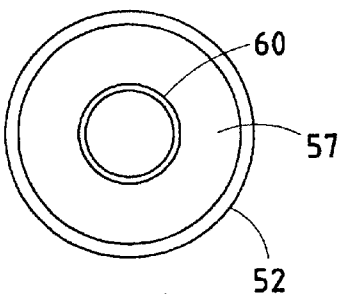
FIG. 4 is an end plan view of rigid spacer of the recoil dampening assembly.
Figure 2A:
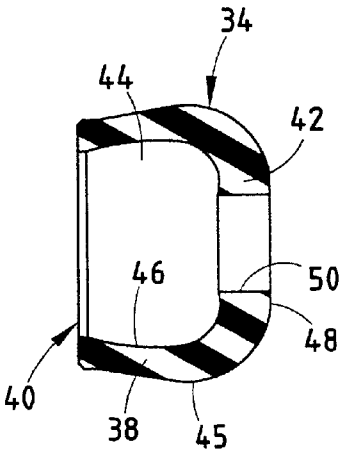
FIG. 2A is a cross-sectional side elevational view of a shock-absorbing member of the recoil dampening assembly.
Figure 3:
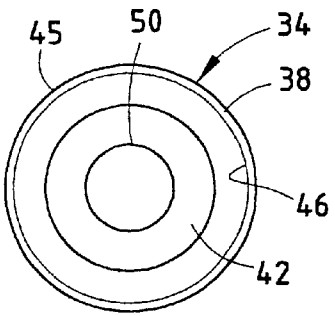
FIG. 3 is an end plan view of the shock-absorbing member.

Each shock absorbing member 34 (FIGS. 2A, 2B, and 3) is provided an overall cup-shaped cross-sectional geometry.

Specifically, each shock absorbing member 34 includes a cylindrically shaped outer wall 38, an open end 40, and an end wall 42. Outer wall 38 and end wall 42 cooperate to define a compression area or zone 44 therein. Outer wall 38 includes a curved outer surface 45 and a curved inner surface 46. Outer wall 38 curves inwardly towards compression area 44 as the distance from end wall 42 increases. End wall 42 includes a flat end surface 48 and a centrally located, longitudinally extending aperture 50 extending between end surface 48 and compression area 44. Aperture 50 is adapted to slidingly receive central portion 30 of rod 20 therein. Each shock absorbing member 34 is constructed of an elastically deformable material such as rubber or synthetic polymeric material, however, other suitably materials may be utilized.

Figure 5:
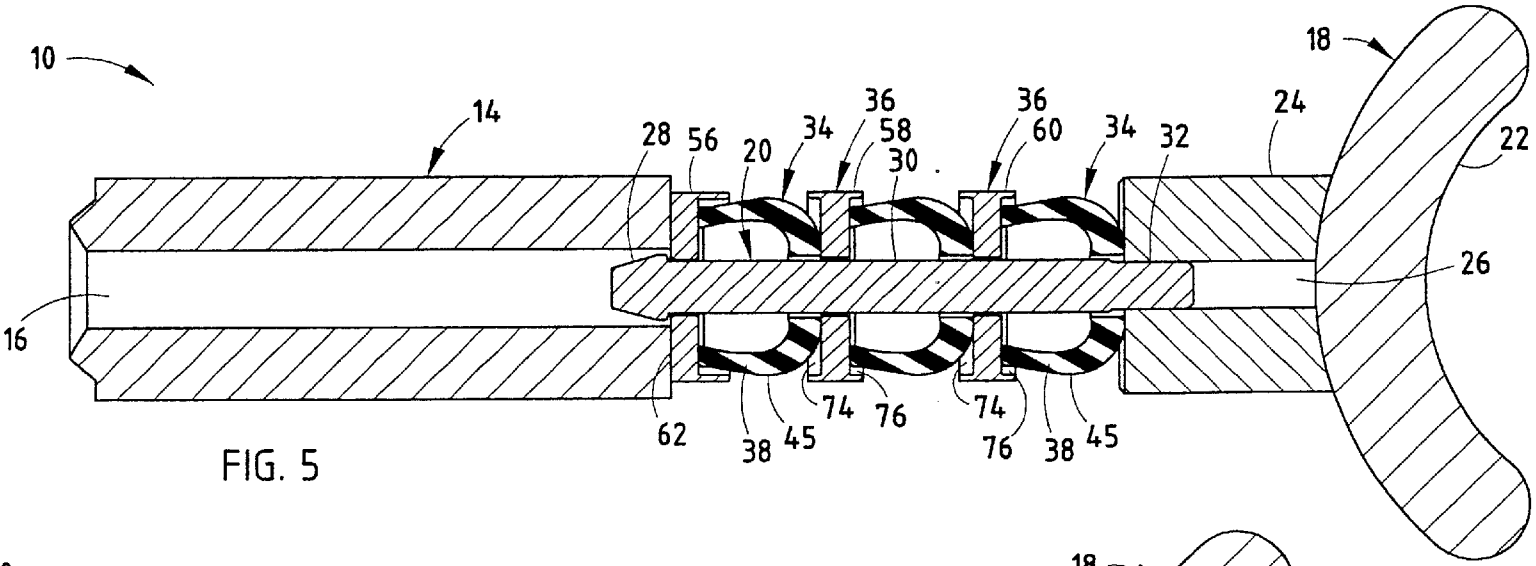
FIG. 5 is a cross-sectional side elevational view of the recoil dampening assembly in an uncompressed state.

Each spacer 36 is constructed of a rigid material such as steel or polycarbinate, however, other suitably materials may be utilized. In the illustrated example, spacers 36 include a first spacer 56, a second spacer 58 and a third spacer 60. First spacer 56 includes a first end surface 62 and a second end surface 64. Second end surface 64 includes a circularly-shaped, inwardly extending recess 66 adapted to receive a portion of shock absorbing member 34 therein. First spacer 56 further includes a longitudinally extending centrally locate bore 68 that extends between first end surface 62 and second end surface 64 is adapted to slidingly receive central portion 30 of rod 20 therein. Second spacer 58 and third spacer 60 each include a first end surface 70 and a second end surface 72, that include a circularly-shaped inwardly extending recess 74 and an inwardly extending circularly-shaped recess 76, respectively. Recesses 74 and 76 are adapted to receive a portion of shock absorbing members 34 therein as shown in FIG. 5. Second spacer 58 and third spacer 60 also each include a centrally located longitudinally extending bore 78 that extends between the associated first end surface 70 and second end surface 72 and is adapted to slidingly receive central portion 30 of rod 20 therein.

In assembly and as illustrated in FIG. 5, shock absorbing members 34 and spacers 36 are interspaced along central portion 30 of rod 20, while second end 32 of rod is fixedly received within bore 26 of impact member 24, and first end 28 of rod 20 is slidingly received within bore 16 of bolt assembly 14. In the illustrated example, a portion of outer wall 38 of each shock absorbing member 34 is located within a recess of spacers 36. Specifically, a portion of outer wall 38 of the two aftmost shock absorbing members 34 are seated within recesses 76 of second spacer 58 and third spacer 60, while a portion of outer wall 38 of the forward-most shock absorbing member 34 is seated within recess 66 of first spacer 56. Similarly, a portion of end wall 42 of the two most forward shock absorbing members 34 are seated within recesses 74 of second spacer 72 and third spacer 60, while end surface 48 of the most aft shock absorbing member 34 abuts impact member 24. First end surface 62 of first spacer 56 abuts bolt assembly 14. Although the illustrated example includes three shock-absorbing members 34 and three spacers 36, it should be noted that any number of shock-absorbing members 34 and spacers 36 may be utilized depending on the particular application.

Figure 6:
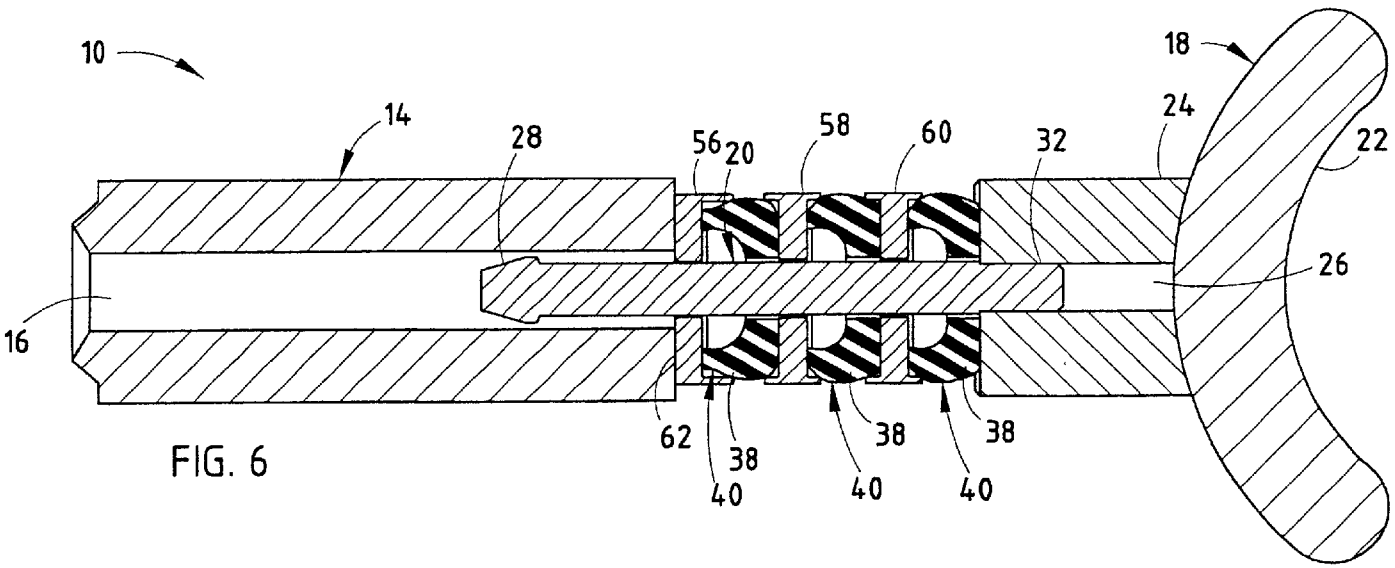
FIG. 6 is a cross-sectional side elevational view of the recoil dampening assembly in a compressed state.

In operation, as best illustrated in FIG. 6, a charge ignited within the associated firearm 10 exerts a rearward force on bolt assembly 14. The rearward force exerted on bolt assembly 14 is in turn transferred to first spacer 56 and then rearwardly propagates along recoil dampening assembly 12 until it is received by stock 18. The force exerted on recoil dampening assembly 12 is received and dampened by shock absorbing members 34 as it propagates rearwardly. Specifically, the force received by shock absorbing members 34 causes outer wall 38 of each member 34 to compress and flatten into compression area 34, thereby dissipating and absorbing the force received. After receiving the force, the outer wall 38 of each shock absorbing member 34 resiliently resumes its original geometrical shape.

The firearm recoil dampening assembly 12 of the present invention provides a more durable recoil dampening assembly at a reduced cost. The dampening assembly includes an uncomplicated design and can be easily and quickly assembled and disassembled. Further, the dampening assembly is economical to manufacture, capable of a long operating life, and particularly well adapted for the proposed use.

These and other advantages of the invention will be further understood and appreciated by those skilled in the art by reference to the following written specification, claims, and appended drawings.

The invention claimed is:

1. A recoil dampening assembly for a firearm that includes a bolt assembly and a stock that is linearly moveable with respect to the bolt assembly, comprising:

a plurality of elastically deformable, cup-shaped shock-absorbing members having a compression cavity defined therein; and a plurality of rigid spacers interspaced between the shock-absorbing members;

wherein the plurality of shock-absorbing members and rigid spacers are adapted to be placed between a bolt assembly of a firearm and a stock of the firearm, and wherein the plurality of shock-absorbing members and rigid spacers are further adapted to dampen the recoil as transmitted from the bolt assembly to the stock when a charge within the firearm is ignited by allowing each shock-absorbing member to at least partially compress within the compression cavity.

2. The recoil dampening assembly of claim 1, wherein the shock-absorbing members are cylindrically shaped.

3. A recoil dampening assembly for a firearm that includes a bolt assembly and a stock that is linearly moveable with respect to the bolt assembly, comprising:

a plurality of elastically deformable shock-absorbing members having a compression cavity defined therein, wherein the shock-absorbing members are cylindrically shaped, and wherein the cavity of the shock-absorbing member is defined by a cylindrically shaped outer wall, and wherein the shock-absorbing member has an open first end and a second end that includes an end wall; and a plurality of rigid spacers interspaced between the shock-absorbing members;

wherein the plurality of shock-absorbing members and rigid spacers are adapted to be placed between a bolt assembly of a firearm and a stock of the firearm, and wherein the plurality of shock-absorbing members and rigid spacers are further adapted to dampen the recoil as transmitted from the bolt assembly to the stock when a charge within, the firearm is ignited by allowing each shock-absorbing member to at least partially compress within the compression cavity.

4. The recoil dampening assembly of claim 3, wherein the outer wall of the shock-absorbing member is inwardly curved.

5. The recoil dampening assembly of claim 4, wherein the spacers have a first end and a second end, the first and second ends of at least some of the spacers have an inwardly extending recess, and wherein a portion of the shock-absorbing members are seated within the recesses of the spacers.

6. The recoil dampening assembly of claim 5, wherein each of the shock-absorbing members and each of the spacers include a longitudinally extended aperture adapted to receive therein a bolt extending between the bolt assembly and stock.

7. The recoil dampening assembly of claim 6, wherein at least one of the shock-absorbing members is adapted to abut the stock.

8. The recoil dampening assembly of claim 7, wherein at least one of the spacers is adapted to abut the bolt assembly.

9. The recoil dampening assembly of claim 8, wherein the plurality of shock-absorbing members includes at least three shock-absorbing members.

10. The recoil dampening assembly of claim 9, wherein the plurality of spacers includes at least three spacers.

11. The recoil dampening assembly of claim 1, wherein the cavity of the shock-absorbing member is defined by a cylindrically shaped outer wall, and wherein the shock-absorbing member has an open first end and a second end that includes an end wall.

12. The recoil dampening assembly of claim 1, wherein the cavity of the shock-absorbing member is defined by a cylindrically shaped outer wall, and wherein the outer wall of the shock-absorbing member is inwardly curved.

13. The recoil dampening assembly of claim 1, wherein the spacers have a first end and a second end, the first and second ends of at least some of the spacers have an inwardly extending recess, and wherein a portion of the shock-absorbing members are seated within the recesses of the spacers.

14. The recoil dampening assembly of claim 1, wherein each of the shock-absorbing members and each of the spacers include a longitudinally extended aperture adapted to receive therein a bolt extending between the bolt assembly and stock.

15. The recoil dampening assembly of claim 1, wherein at least one of the shock-absorbing members is adapted to abut the stock.

16. The recoil dampening assembly of claim 1, wherein at least one of the spacers is adapted to abut the bolt assembly.

17. The recoil dampening assembly of claim 1, wherein the plurality of shock-absorbing members includes at least three shock-absorbing members.

18. The recoil dampening assembly of claim 1, wherein the plurality of spacers includes at least three spacers.

19. A firearm including a recoil dampening assembly, comprising:

a bolt assembly;

a stock that is linearly moveable with respect to the bolt assembly;

a plurality of elastically deformable, cup-shaped shock-absorbing members having a compression cavity defined therein;

a plurality of rigid spacers interspaced between the shock-absorbing members;

wherein the plurality of shock-absorbing members and rigid spacers are positioned between the bolt assembly and the stock of the firearm, and wherein the plurality of shock-absorbing members and rigid spacers are adapted to dampen the recoil as transmitted from the bolt assembly to the stock when a charge within the firearm is ignited.

20. The firearm of claim 19, wherein the shock absorbing members are cylindrically shaped.

21. The firearm of claim 19, wherein the cavity of the shock-absorbing member is defined by a cylindrically shaped outer wall, and wherein the shock-absorbing member has an open first end and a second end that includes an end wall.

22. The firearm of claim 21, wherein the outer wall of the shock-absorbing member is inwardly curved.

23. The firearm of claim 19, wherein the outer wall of the shock-absorbing member is inwardly curved.

24. The firearm of claim 19, wherein the spacers have a first end and a second end, the first and second ends of at least some of the spacers have an inwardly extending recess, and wherein a portion of the shock-absorbing members are seated within the recesses of the spacers.

25. The firearm of claim 19, further including:

a bolt operably connecting the bolt assembly and the stock; and wherein each of the shock-absorbing members and each of the spacers include a longitudinally extended aperture adapted to receive the bolt therein.

26. The firearm of claim 19, wherein at least one of the shock-absorbing members is adapted to abut the stock.

27. The firearm of claim 19, wherein at least one of the spacers is adapted to abut the bolt assembly.

28. The firearm of claim 19, wherein the plurality of shock-absorbing members includes at least three shock-absorbing members.

29. The firearm of claim 28, wherein the plurality of spacers includes at least three spacers.

30. The firearm of claim 19, wherein the firearm is semi-automatic.

31. The firearm of claim 19, wherein the firearm is fully automatic.

32. A recoil dampening assembly for a firearm that includes a bolt assembly and a stock that is linearly moveable with respect to the bolt assembly, comprising:

a plurality of elastically deformable shock-absorbing members having a compression cavity defined therein; and a plurality of rigid spacers interspaced between the shock-absorbing members, wherein the spacers have a first end and a second end, the first and second ends of at least some of the spacers have an inwardly extending recess, wherein a portion of the shock-absorbing members are seated within the recesses of the spacers, and wherein each of the shock-absorbing members and each of the spacers include a longitudinally extended aperture adapted to receive therein a bolt extending between the bolt assembly and the stock;

wherein the plurality of shock-absorbing members and rigid spacers are adapted to be placed between a bolt assembly of a firearm and a stock of the firearm, and wherein the plurality of shock-absorbing members and rigid spacers are further adapted to dampen the recoil as transmitted from the bolt assembly to the stock when a charge within the firearm is ignited by allowing each shock-absorbing member to at least partially compress within the compression cavity.

33. The recoil dampening assembly of claim 3, wherein the cavity of the shock-absorbing member is defined by a cylindrically shaped outer wall.

34. The recoil dampening assembly of claim 3, wherein the cavity of the shock-absorbing member is defined by a cylindrically shaped outer wall, and wherein the outer wall of the shock-absorbing member is inwardly curved.

35. The recoil dampening assembly of claim 3, wherein the spacers have a first end and a second end, the first and second ends of at least some of the spacers have an inwardly extending recess, and wherein a portion of the shock-absorbing members are seated within the recesses of the spacers.

36. The recoil dampening assembly of claim 3, wherein each of the shock-absorbing members and each of the spacers include a longitudinally extended aperture adapted to receive therein a bolt extending between the bolt assembly and stock.

37. The recoil dampening assembly of claim 3, wherein at least one of the shock-absorbing members is adapted to abut the stock.

38. The recoil dampening assembly of claim 3, wherein at least one of the spacers is adapted to abut the bolt assembly.

39. The recoil dampening assembly of claim 3, wherein the plurality of shock-absorbing members includes at least three shock-absorbing members.

40. The recoil dampening assembly of claim 3, wherein the plurality of spacers includes at least three spacers.

41. A firearm including a recoil dampening assembly, comprising:

a bolt assembly;

a stock that is linearly moveable with respect to the bolt assembly;

a plurality of elastically deformable shock-absorbing members having a compression cavity defined therein, wherein the shock-absorbing members are cylindrically shaped, the cavity of the shock-absorbing member is defined by a cylindrically shaped outer wall, and wherein the shock-absorbing member has an open first end and a second end that includes an end wall; and a plurality of rigid spacers interspaced between the shock-absorbing members;

wherein the plurality of shock-absorbing members and rigid spacers are positioned between the bolt assembly of the firearm and the stock of the firearm, and wherein the plurality of shock-absorbing members and rigid spacers are further adapted to dampen the recoil as transmitted from the bolt assembly to the stock when a charge within the firearm is ignited by allowing each shock-absorbing member to at least partially compress within the compression cavity.

* * * * *

UNITED STATES PATENT AND TRADEMARK OFFICE

CERTIFICATE OF CORRECTION

PATENT NO. : 6,684,547 B2
DATED : February 3, 2004
INVENTOR(S) : Poff, Jr.

It is certified that error appears in the above-identified patent and that said Letters Patent is hereby corrected as shown below:

Title page,
Item [75], Inventors, "Vero Beach, FL (US)" should be -- Cape Coral, FL (US) --.

Signed and Sealed this

Twenty-fifth Day of May, 2004

JON W. DUDAS
*Acting Director of the United States Patent and Trademark Office*